United States Patent [19]

Beard

[11] 3,965,714

[45] June 29, 1976

[54] GOLF CLUB BENDING MACHINE FOR SETTING THE LOFT AND LIE ANGLES OF THE CLUB HEAD

[76] Inventor: Franklin Beard, 14906 Cindywood, Houston, Tex. 77024

[22] Filed: Sept. 3, 1974

[21] Appl. No.: 502,970

[52] U.S. Cl. ..... 72/32; 72/394; 72/418; 72/297; 72/412; 72/457

[51] Int. Cl.[2] ..... B21D 7/14; B21D 7/00

[58] Field of Search ..... 72/32, 295, 296, 297, 72/298, 306, 308, 309, 310, 316, 317, 319, 458, 459, 479, 480, 394, 403; 273/167 G

[56] References Cited

UNITED STATES PATENTS 3,357,219 12/1967 Hunter ..... 72/298

3,786,668 1/1974 Crees ..... 72/318

*Primary Examiner*—Milton S. Mehr

*Attorney, Agent, or Firm*—Ranseler O. Wyatt

[57] ABSTRACT

A golf club bending machine for adjusting the club head with reference to the shaft, to vary the position of the head to change the loft and lie angles of the club face in accordance with the user's swing. The device is provided with a clamp to hold the club in position while bending the neck of the club to a predetermined angle, and having a hydraulic power bending unit designed to bend the neck of the club in one position to adjust the lie, and movable into another position to bend the neck of the club to adjust the loft to a predetermined angle.

7 Claims, 9 Drawing Figures

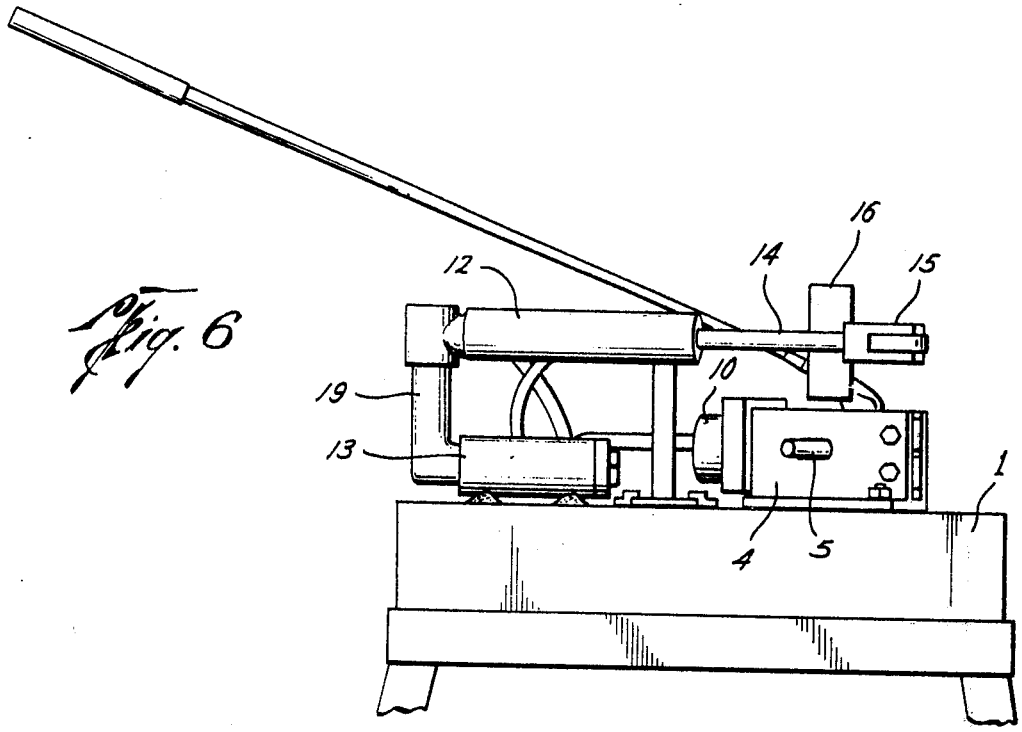
Fig. 6
Fig. 7
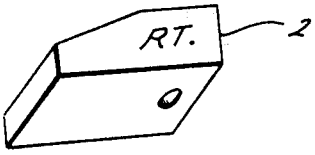
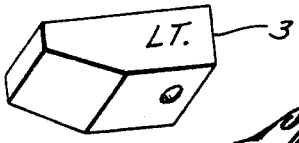
Fig. 8
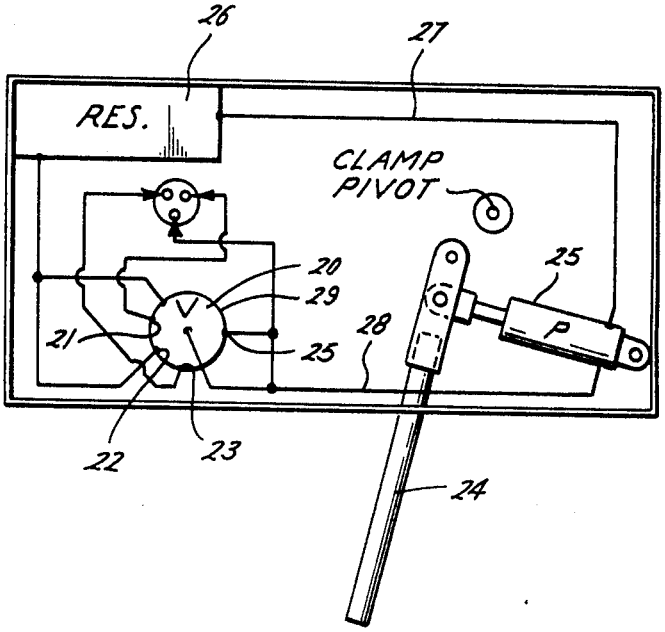
Fig. 9

GOLF CLUB BENDING MACHINE FOR SETTING THE LOFT AND LIE ANGLES OF THE CLUB HEAD

SUMMARY OF THE INVENTION

A golf club bending device having means for holding a golf club head while another means hydraulically powered, bends the neck of the club in one direction to adjust the lie angle of the club to a predetermined angle, and said hydraulically powered means being movable to another position to permit the neck of the club to be bent to a predetermined angle to adjust the loft angle of the club.

Many professional golfers have their clubs tailored to their particular swing, which is the most desireable way to obtain the maximum results from the clubs, however, this is often a very costly procedure, and beyond the reach of the average golfer. The device herein defined is intended to provide an inexpensive and relatively simple means for the average golfer to have his clubs tailored to his individual swing. Means are available for a golfer to determine the loft and lie angles of his club in connection with his individual swing, and it is from the information so obtained that the clubs are adjusted by means of the herein described device.

BRIEF DESCRIPTION OF THE DRAWINGS

FIG. 6 is a side elevational view of the unit, showing a club in position in the machine.

FIG. 7 is a side elevational view of the clamp die for the right handed club.

FIG. 8 is a side elevational view of the clamp die for the left hand club, and FIG. 9 is a diagrammatic sketch of the hydraulic system employed.

DESCRIPTION OF THE PREFERRED EMBODIMENT

Figure 1:
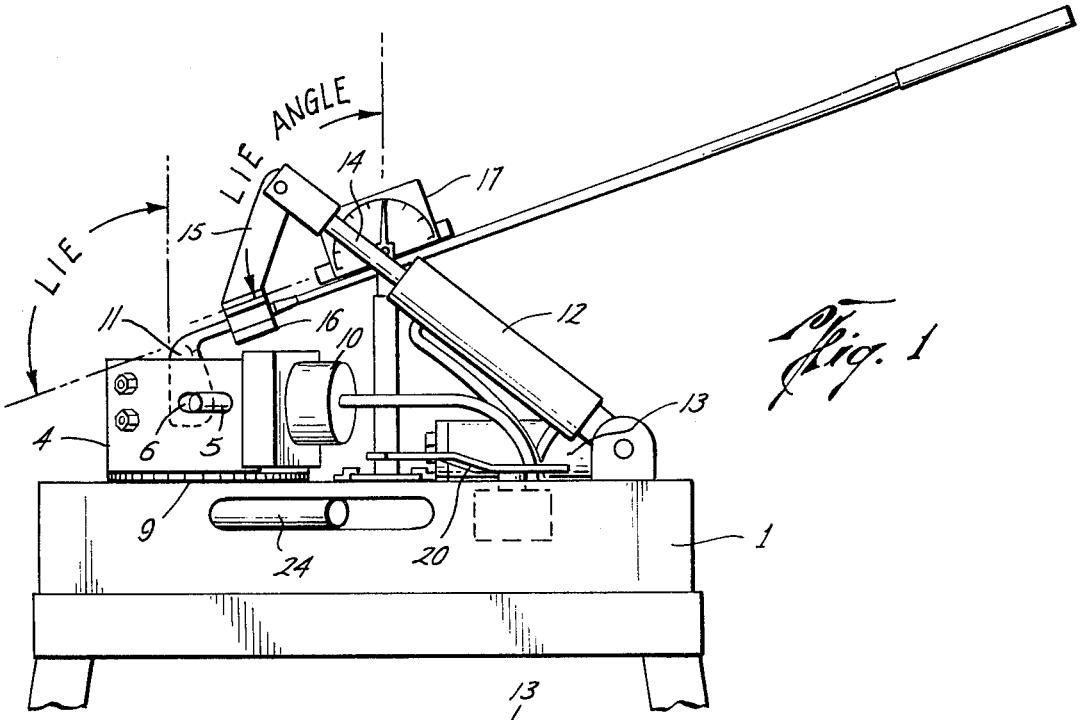
FIG. 1 is a side elevational view of the device, showing a club mounted in the machine and in position for a lie adjustment.
Figure 2:
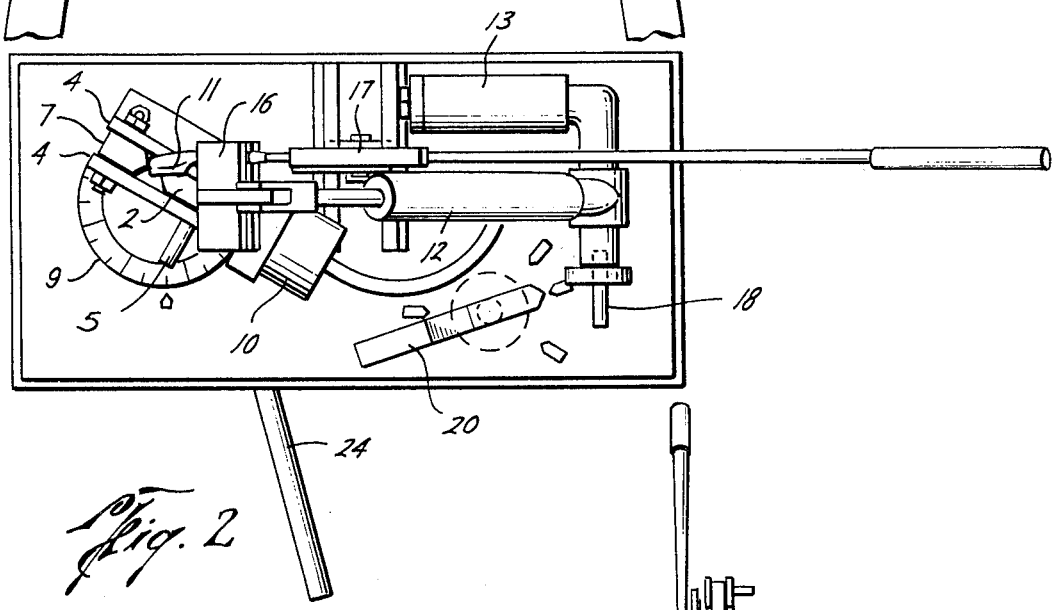
FIG. 2 is a top plan view of the device shown in FIG. 1.
Figure 3:
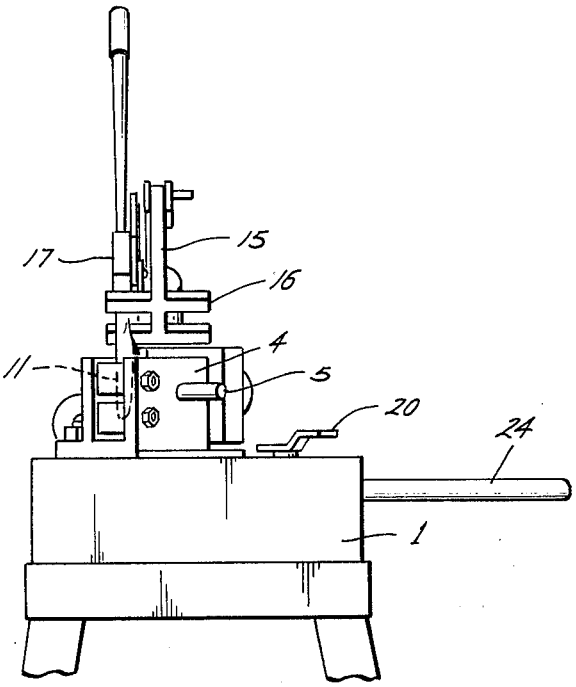
FIG. 3 is an end view of the device shown in FIG. 1.
Figure 4:
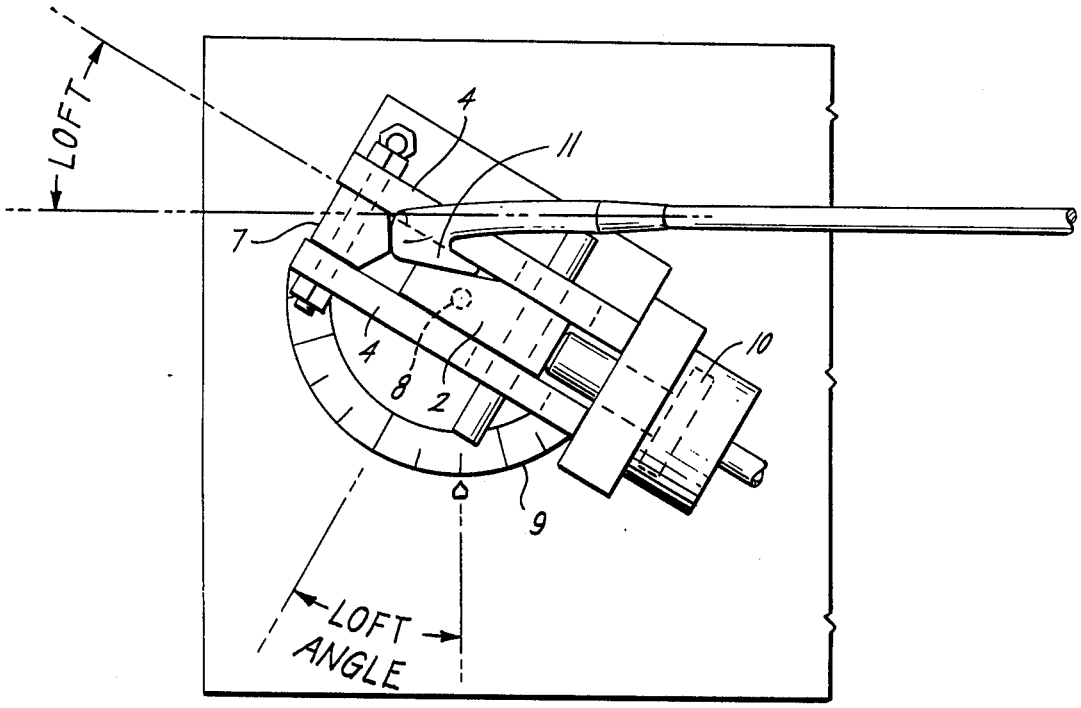
FIG. 4 is a top view of the device, showing the club head clamping means and the gauge for setting the angle to be acquired for the loft adjustment.

In the drawings, the numeral 1 designates a base member supporting the device. A clamp die, as 2, or 3, one for right hand clubs and the other for left hand clubs, respectively, is longitudinally movable in the channel formed by the side members 4, 4, the handle 5 extending through the slot 6 of one of the side members, permits manual movement of the die 2, and the double faced cooperating clamp member 7 fixedly mounted between said side members 4, 4.

The side members 4, 4 are part of the clamping assembly which is rotatable on the axle 8, mounted in the base member 1 and the gauge 9, an integral part of the clamp assembly, permits predetermined setting of the angle of bend desired. The hydraulic ram 10 moves the die 2 against the club head, as 11, as hereinafter described, the beveled edge of the die 2 bearing against the obverse side of the club head 11, and the face of the club abutting the side wall 4, and moving the sole of the club against the appropriate face of the clamp member

7, the clamp assembly pivoting according to the angle of the club face, with the pivoting according to the angle of the club face, with the shaft of the club maintained in a parallel position relative to the longitudinal side walls of the base member 1. A marker on the top wall of the base member will give the reading on the gauge 9 and the pump handle 24 actuated to force the sole of the club along the tapered face of the member 7 until the neck of the club is bent to the desired loft reading on the gauge 9.

The vertical adjusting ram 12 is pivotally mounted in the sleeve 13, and the ram shaft 14 extends outwardly from the ram 12 and the club neck receiver 15 is pivotally suspended from the end of the ram shaft 14. The lower end of the neck receiver is upwardly turned, forming a channel member 16 in which the neck of the club rests during bending operations.

The cylinder 12 is adjusted to hold the club in the receiver at the angle formed when the club head is in the clamp with the die 2 holding the sole of the club against the selected face of the member 7, and the vertical face of the selected portion of the member 7 being parallel with the longitudinal face of the sole in vertical position. The gauge 17 may be then examined to determine the lie angle of the club, and the ram in the cylinder 12 actuated to move the ram 14 outwardly the desired distance, bending the club neck to acquire the desired lie angle. The gauge rotating as the neck bends, so that the bend may be terminated when the desired reading is attained.

To bend the club neck to the desired loft angle, the club is secured in the clamp as above described, and the cylinder 12 is released from locking position by releasing the pin 18 from engagement with the pivotal support 19, and pivoting the support bearing the cylinder 12 and ram 14 upwardly to the position shown in FIG. 6. The loft angle is read on the gauge 9, and the neck of the club is bent by actuation of the ram 14 the desired distance.

In operation, the ram 14 is propelled forwardly by moving the control 20 to the position 21 to effect a right bend, and to the position 23 to effect a left bend. The power for actuation of the ram may be through any suitable source, such as a pump 25 actuated by the handle 24, which hydraulically operates the pistons in respective rams.

Figure 5:
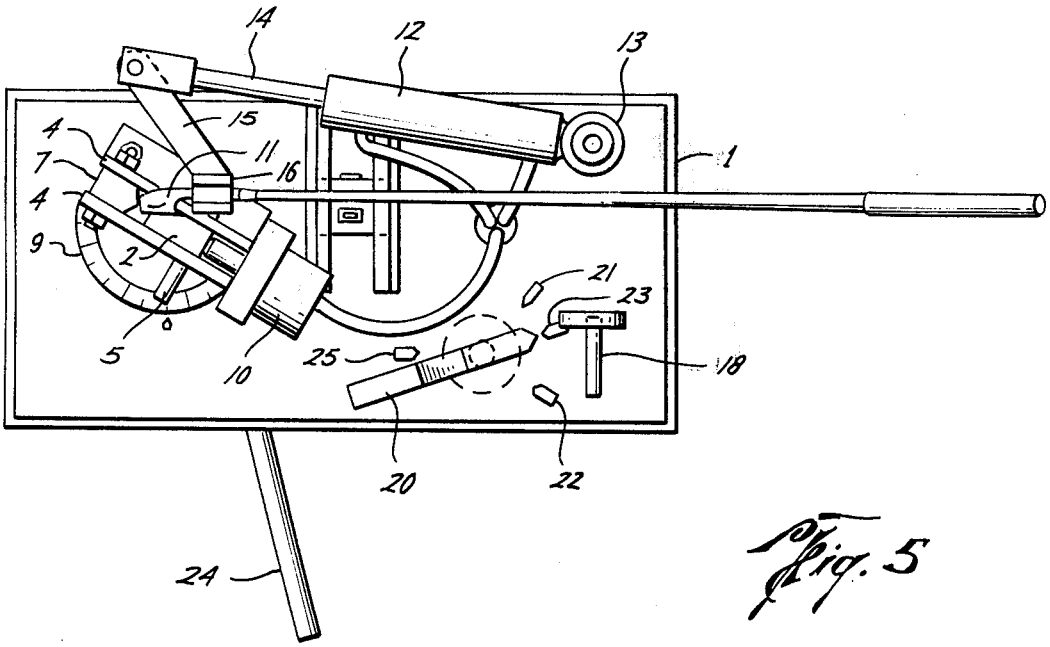
FIG. 5 is a top plan view illustrating the hydraulic control means.

The club user determines the desired adjustment by using a loft and lie detector, and having determined the adjustment necessary for the particular club, the club head is placed between the members 2, 7, in the channel formed by the side members 4, 4, with the sole of the club head bearing against a selected section of the member 7, depending on whether the club user is right handed, or left handed. The control 20 is then moved to the clamping position 25, and the pump actuated by the user to apply pressure to the club head, so that the die 2 will move against the club head, forcing the face of the club against the side member 4, opposite the tapered face of the die, and the sole of the club will be moved against the selected portion of the member 7. The receiver 16 is then moved into position to receive the neck of the club, and the lie angle of the club is read on the gauge 17. The control 20 is then moved to position 21 or 23, depending on the direction of bend desired, and the pump is again actuated to move the ram 14 outwardly until the bend is made to the desired predetermined position. The control 20 is then moved to the position 22, to relieve the pressure against the respective rams, and the clamp is relieved by manually moving the member 2 out of contact with the club, by means of the handle 5. It it is desired to also adjust the club head as to the loft angle, before the clamp is released, the pin 18 is withdrawn from the member 19, and the cylinder 12 pivoted into the loft adjusting position, as shown in FIG. 5, with the receiver 16 maintaining the club shaft parallel with the longitudinal side of the base member 1, and the degree of loft angle is read on the gauge 9. The control 20 is then moved to one of positions 21, 23, depending on the direction of bend desired, and the handle of the pump actuated applying pressure to the ram 10, forcing the movable die against the face of the club and forcing the toe of the club against the selected face of the die 11 until the desired distance of bend has been accomplished. The control 20 is then moved to the position 22, and the die 2 manually moved out of clamping position by means of the handle 5, and the club removed from the receiver 16.

The diagrammatic sketch of FIG. 9 discloses the hydraulic system employed, including the reservoir from which the supply line 27 leads to the pump 25 and the line 28, which leads from the pump to the control cylinder 29.

I claim:

1. In a machine for adjusting the loft and lie angles of a golf club head, a base member, a clamp pivotally mounted on said base member, said clamp having certical walls, means for releasably anchoring a golf club head in vertical position in said clamp on said base member and releasably anchoring the hosel of said club in parallel alignment with the longitudinal walls of said base member, and means for selectively applying hydraulic pressure to cooperating members of said clamp to bend the neck of the club a predetermined distance to obtain the desired loft angle and to selectively move said means for anchoring said hosel to bend the neck of said club to the desired lie angle.

2. The device defined in claim 1 wherein the means for anchoring the golf club head in vertical position consists of a die seated in said clamp having a tapered face adapted to abut against the club head on the side opposite the face of the club and as pressure is applied to the club head to move the club face along a vertical wall of said clamp and to move the sole against a beveled face fixed clamp member mounted in one end of said clamp moving the head and bending the neck of the club until the desired angle is acquired.

3. The device defined by claim 1 wherein said bending means consists of a pair of manually operated hydraulic rams, one of said rams being pivotally mounted and having a neck engaging means on the extended end thereof adapted to move in a selected direction in response to hydraulic pressure applied to said ram and the other of said rams being mounted on said clamp, cooperating dies in said clamp between which a golf club head is received and the desired bend accomplished by moving one of said dies against said head and towards the other die while said first mentioned ram maintains the neck of said club in a fixed position.

4. The device defined in claim 1 wherein said anchoring means consists of a longitudinal channel having vertical side walls, a die having a tapered face to abut against the side of the club opposite the face thereof, said die being movable longitudinally in said channel and a fixed member having a pair of tapered faces to selectively receive the sole of said club as said die moves said club into position, means for applying pressure to said hosel to maintain said head in position, means for manually pumping pressure against said die to force said sole along the tapered face of said fixed member until the desired bend is accomplished and manual means for withdrawing said die when said pressure is relieved.

5. The device defined in claim 1 wherein said means for applying pressure to bend the neck of said club is provided with gauges to read the distance of the respective bends.

6. The device defined in claim 1 wherein said anchoring means consists of a longitudinal channel having vertical side walls, a die having a tapered face to abut against the side of the club opposite the face thereof, said die being movable longitudinally in said channel and a fixed member having a pair of tapered faces to selectively receive the sole of said club as said die moves said club onto anchored position, means for applying pressure to said die to maintain said head in position, and to selectively force said sole along the tapered face of said fixed member until the desired bend is accomplished and manual means for withdrawing said die when said pressure is relieved.

7. The device defined in claim 1 wherein one of said means for applying pressure to bend the neck of said club is pivotally mounted on said base member, gauges on said base member to determine the loft and lie angles, respectively, and manually actuated hydraulic means adopted to effect the desired bend while said hosel is maintained in a fixed position and a control for directing the hydraulic pressure so generated selectively to accomplish the bend desired, and for releasing the pressure so applied, when the desired bend is accomplished.

* * * * *